US005610367A

United States Patent [19]

Erickson et al.

[11] Patent Number: 5,610,367

[45] Date of Patent: Mar. 11, 1997

[54] NON-TOXIC RIM-FIRE PRIMER

[75] Inventors: Jack A. Erickson; John M. Melberg, both of Andover; Robert L. Kramer, Minneapolis; John M. Hallis, Buffalo, all of Minn.

[73] Assignee: Federal-Hoffman, Inc., Anoka, Minn.

[21] Appl. No.: 539,857

[22] Filed: Oct. 6, 1995

[51] Int. Cl.[6] ..... C06B 35/00

[52] U.S. Cl. ..... 149/35; 149/96

[58] Field of Search ..... 149/35, 36, 96

[56] References Cited

U.S. PATENT DOCUMENTS

| | | | |
|---|---|---|---|
| 3,574,298 | 4/1971 | Larson | 102/22 |
| 4,142,927 | 3/1979 | Walker et al. | 149/19.4 |
| 4,196,026 | 4/1980 | Walker et al. | 149/46 |
| 4,304,614 | 12/1981 | Walker et al. | 149/46 |
| 4,363,679 | 12/1982 | Hagel et al. . | |
| 4,366,084 | 6/1982 | Urs | 149/24 |
| 4,366,085 | 6/1982 | Walker et al. | 149/45 |
| 4,608,102 | 8/1986 | Krampen et al. . | |
| 4,675,059 | 6/1987 | Mei . | |
| 4,963,201 | 10/1990 | Bjerke et al. . | |
| 5,167,736 | 12/1992 | Mei et al. . | |
| 5,216,199 | 6/1993 | Bjerke et al. . | |
| 5,388,519 | 2/1995 | Guindon et al. . | |
| 5,466,315 | 11/1995 | Erickson et al. | 149/96 |

OTHER PUBLICATIONS

Copper, Committee on Medical and Biologic Effects of Environmental Pollutants, 1977.

*Primary Examiner*—Charles T. Jordan
*Assistant Examiner*—John R. Hardee
*Attorney, Agent, or Firm*—Shroeder & Siegfried, P.A.

[57] ABSTRACT

A lead-free rim-fire primer mix which utilizes cupric azide, a highly sensitive chemical, as the primary explosive in lieu of lead styphnate. The cupric azide is mixed with carefully selected proportions of nitrocellulose, tetracene, fine particles of ground glass and a binder, typically gum tragacanth. When mixed in the proper proportions, this mix has the required sensitivity, stability, and non-hygroscopicity for regular commercial rim-fire ammunition. The tetracene is not required as a sensitizer, but is used as an ignition aid. The preferred range of percentages are 10–36% by weight of cupric azide, 5–10% by weight of tetracene, 15–30% by weight of nitrocellulose, 20–50% by weight of glass, and 1–2% by weight of a suitable gum.

42 Claims, No Drawings

NON-TOXIC RIM-FIRE PRIMER

BACKGROUND OF THE INVENTION

Priming compositions have undergone relatively gradual changes. In their early history, mercury fulminate was most commonly used. This material, however, was found to deteriorate too rapidly under tropical conditions. For a time, in the 1920's, lead thiocyanate/potassium chlorate formulations were used, but these proved detrimental to weapon barrels because they formed corrosive potassium chloride salts upon firing. Late in the 1930's a new class of primer mix, based upon lead styphnate, which is much more stable than mercury fulminate, was discovered and widely adopted. In fact, it is still widely in use today by rim-fire ammunition manufacturers. It, too, has its disadvantages in that it discharges lead and other heavy metals into the air upon firing. Consequently, the men of the art are looking for a suitable and improved substitute, even though they agree that lead styphnate has many advantages over most rim-fire primary explosives.

Center-fire and rim-fire primer mix requirements are considerably different because of the geometry of the metal parts in which they are used.

In a center-fire primer, the primer mix is positioned between a well defined anvil and the cup wall, and the mix can be processed so as to have a high material density. These two factors, positive cup and anvil surface interaction, and a high density of primer mix give a reliable ignition system.

In a rim-fire system, on the other hand, the anvil effect is not as positive because the rim of the case is only "pinched", and the high density of priming can not readily be achieved as it is spun into the rim in a wet "plastic" condition.

Therefore, rim-fire primer mixes must be intrinsically more sensitive to make up for the lack of material density and positive anvil effect.

Today, all commonly used rim-fire primer mix materials have three (3) main ingredients, namely: (a) a primary explosive, such as lead styphnate, (b) an oxidizing agent, such as barium nitrate, and (c) a fuel source such as antimony sulphide. Sensitizers, such as tetracene, and binders are also added to these above main ingredients. In the past ten years, however, many researchers have been seeking a non-toxic, or less toxic, primer composition. Many of the various patents which have issued show the significant drawbacks of the primer mixes heretofore utilized, as described hereinbelow. Many of these primer mixes were developed primarily for center-fire cartridges which, as described above, have a considerably different structure and mechanism for detonating the primary explosive.

One of the earlier patents issued to Krampen et al under U.S. Pat. No. 4,608,102, which uses diazodinitrophenol (DDNP) as the primary explosive and manganese dioxide as the oxidizer.

Another earlier patent issued to Hazel under U.S. Pat. No. 4,363,679. This invention utilizes a smokeless propellant, a titanium fuel and a zinc peroxide oxidizer.

U.S. Pat. No. 4,674,409, issued to Lopata, uses DDNP, tetracene, manganese dioxide and glass. It also uses a metal foil disk of compacted nitrocellulose which is positioned adjacent the primer mix in order to hold it in place. The disk requires an extra part and additional overhead and labor costs.

The Bjerke Pat. No. 4,963,201 also uses DDNP or potassium dinitrobenzofuroxanne as the primary explosive, nitrate ester as a fuel, and strontium nitrate as the oxidizer.

The inventors of the Bjerke et al patent, U.S. Pat. No. 5,216,199, compact some of the propellant against the primer mix in the belief that the primary explosive functions more effectively if made more dense. They utilize DDNP, tetracene, a suitable propellant, glass and strontium nitrate. Inclusion, herein, by reference thereto, is hereby made of the portion of said U.S. Pat. No. 5,216,199 which is entitled "Background of the Invention," because of its background discussions:

U.S. Patent No. 5,388,519, issued to Guindon et al, sets forth a helpful plurality of paragraphs in Columns 1 and 2 which describe many of the problems and their considerations in a primer having reduced toxicity. It, too, suggests the use of DDNP as the primary explosive along with a mechanical frictionator (glass or aluminum), a fuel, and an oxidizer selected from a group which includes strontium sulphate and strontium oxalate as well as cupric or ferric oxide. It points out that the presence of tetracene can cause thermal instability. It also lists a number of additional U.S. patents which are relevant to the development of a new and improved primer mix.

U.S. Pat. No. 4,675,059, issued to George C. Mei, discloses a non-toxic primer mix which contains DDNP, manganese dioxide as an oxidizer, tetracene and glass.

U.S. Pat. No. 4,963,201 issued to Bjerke et al, also suggests the use of DDNP or potassium dinitrobenzofuroxanne as a primary explosive, tetracene, a nitrate ester fuel, and strontium nitrate.

U.S. Pat. No. 5,167,736, issued to Mei et al, discloses a non-toxic primer which is principally comprised of DDNP and boron. It may also contain calcium carbonate or strontium nitrate as an oxidizer, a nitrate ester as a fuel, and tetracene as a secondary explosive.

The above patents and all others which utilize DDNP as the primary explosive for primer mixes are probably more effective for center-fire cartridges than for rim-fire cartridges, because the anvil construction of the primer body of the center-fire cartridges compensates for the lack of adequate sensitivity found in DDNP. The lead-free center-fire mixes have been fairly successful, as such, but when utilized as rim-fire primer mixes, they have not been sufficiently reliable to permit their use for regular commercial ammunition.

As indicated above, lead styphnate is in common use today as a primary explosive. Also barium nitrate is a heavy metal oxidizer which is used today by almost all rim-fire primer manufacturers to cause the fuel to burn more effectively. Because of the heavy metal presence in its composition in barium nitrate, as well as in antimony sulphide, the United States Federal Bureau of Investigation is seeking a less toxic composition.

It has long been known that cupric azide is a sensitive and powerful producer of flame, and is very brisant. However, unlike lead azide, it has not previously been used in primer mixes, especially in non-toxic mixes. It has undoubtedly been tried, but has never been found to be acceptable for regular commercial ammunition manufacture.

Cupric azide is so highly sensitive that heretofore it has been generally ruled out of consideration for use as a safe primary explosive for rim-fire primer compositions. We have discovered, however, that it can be utilized safely, if mixed with the proper materials and in the right proportions, as described hereinafter. Its use makes it possible to eliminate the presence of lead styphnate, and thereby obviate the adverse consequences of vapors of lead which are presently associated with the firing of primer mixes which are based upon the use of lead styphnate as the primary explosive.

BRIEF SUMMARY OF THE INVENTION

Our invention consists of the discovery that it is possible to produce a new rim-fire primer mix which has the required sensitivity, stability and non-hygroscopicity to be utilized for the manufacture of regular commercial rim-fire ammunition. It is intended to be used where lead-based toxic primer fumes or particulates are undesirable. It is based upon the use of cupric azide as the primary explosive, in lieu of lead styphnate or other toxic primary explosives.

Our new rim-fire primer mix typically contains cupric azide, nitrocellulose, tetracene, ground glass and a binder, typically, gum tragacanth. The tetracene is used as an ignition aid and is not necessary for sensitizing the mix, because of the recognized high degree of sensitivity of the cupric azide.

The preferred percentage of our new rim-fire primer mix is 18% by weight of cupric azide; 9% by weight of tetracene; 26.2% by weight of nitrocellulose; 45% by weight of glass particles having a 100–200 United States Sieve granulation; and 1.8% by weight of gum tragacanth. Other suitable gums may be utilized, since the gum functions as a binder.

The preferred range of components of our new rim-fire primer mix consists of 10–36% by weight of cupric azide; 5–10% by weight of tetracene; 15–30% by weight of nitrocellulose; 20–50% by weight of glass particles; and 1–2% by weight of a suitable gum such as tragacanth.

The typical range of percentages of the components of our newly discovered rim-fire primer mix are 10–50% by weight of cupric azide; 0–10% by weight of tetracene; 10–45% by weight of nitrocellulose; 10–55% by weight of glass particles; and 1–4% by weight of a suitable gum such as tragacanth.

The most desirable height of fire for our new rim-fire primer mix is 4.5"–5.5". We have tested the stability of our new rim-fire primer mix against our commercial lead-styphnate primer mix and in each case have found it to be satisfactory.

We have found that cupric azide can be safely and economically used as a primary explosive in our new rim-fire primer mix if the percentage of this very fast and brisant material is kept low and the amounts of non-brisant materials and the binder is considerably higher than is normally used.

Thus, it is a primary object of our invention to produce a safe and economical lead-free rim-fire primer mix. We have discovered that this can be accomplished through the use of relatively low percentages, by weight, of cupric azide mixed with relatively-high percentages, by weight, of recognized ignition aids, fuels, and frictionators of small particle sizes.

These and other objects and advantages of the invention will more fully appear from the following description.

DETAILED DESCRIPTION OF THE INVENTION

As indicated hereinbefore, lead styphnate is currently in common use as the primary explosive for rim-fire primer mixes. It is utilized for this purpose primarily because it is so reliable, even though its disadvantages are well recognized. It is known as a good priming mix chemical, which is very stable, reasonably sensitive, and reliable. Barium nitrate is frequently used in conjunction with the lead styphnate as an oxidizer, which provides oxygen for the fuel. It functions to cause the fuel to burn effectively and, consequently, is used by many, if not all, manufacturers of rim-fire primer mixes. Barium, however, is a heavy metal which has adverse health effects. Antimony sulfide is also a heavy metal which is sometimes used, and is frowned upon by the FBI as having toxic side effects.

Tetracene is frequently used in primer mixes as a sensitizer, which has a low explosion point and thus can function as an initiator.

As indicated above, we have found that, although cupric azide is very sensitive and brisant, if it is mixed in small proportions and if the other ingredients are utilized in substantially larger proportions, the resulting mix is safe and functions admirably. In our primer mix, the cupric azide is the primary explosive, and the tetracene is added to supplement the ignition. The glass is added as a frictionator, and the gum tragacanth makes it processable. The gum aids in controlling the sensitivity and is a binder. The amount of the gum tragacanth which is used can be utilized to adjust the sensitivity of the mixture. We use a higher percentage of gum, because we believe it causes the primer to adhere to the rim where it is in a more sensitive position to be ignited by the firing pin as it strikes the rim. As a result, it substantially reduces the number of mis-fires and produces the best performing rim-fire primer mix seen to date. This rim-fire primer mix substantially precludes mis-fires without being too sensitive. It is mixed with the glass particles and then added to the cupric azide to provide a dough-like mixture so that it can be charged and processed. The priming mix is stored wet, charged wet in pellet form, and the pellet is spun into the rim. Then, the material in the casing is dried to become sensitive.

As indicated above, our typical range of percentage of ingredients is 10–50% by weight of cupric azide, 0–10% by weight of tetracene, 10–45% by weight of nitrocellulose, 10–55% by weight of glass particles, and 1–4% by weight of a suitable binder, such as gum tragacanth. If desired, other gums such as guar gum, karaya gum, gum arabic, etc., may be utilized in lieu of gum tragacanth. Each of these gums is suitable and will serve adequately as binders. We prefer gum tragacanth, because it has more body and holds the balance of the primer mix together better.

The glass particles which we utilize are relatively small and uniform. We pass the glass particles through a 100 U.S. sieve and utilize those particles which do not pass through a 200 U.S. sieve. Thus, we utilize a 100–200 U.S. sieve granulation. It appears to us that a better and more reliable rim-fire primer mix is produced when uniform granulation of such size is utilized. We believe it enhances the performance of the mix and provides increased uniformity in results.

The preferred range percentages which we utilize are as follows:

- 10–36% by weight of cupric azide;
- 5–10% by weight of tetracene;
- 15–30% by weight of nitrocellulose;
- 20–50% by weight of glass particles of the size described above; and
- 1–2% by weight of a suitable binder, such as gum tragacanth.

As indicated above, the cupric azide functions as the primary explosive, and the tetracene supplements the ignition, while the nitrocellulose provides heat and acts as a moderator. The glass functions as a frictionator, and the gums function as a binder.

The preferred percentage of components of our improved lead-free rim-fire primer mix is as follows:

18% by weight cupric azide;

9% by weight tetracene;

26.2% by weight nitrocellulose;

45% by weight glass particles; and 1.8% by weight of a suitable gum binder, such as gum tragacanth.

Set forth hereinbelow is a chart reflecting the sensitivity of five different sets of samples of our new lead-free rim-fire mix. These figures are dependent upon the percentages of gum and glass which are utilized.

TABLE 1

| SAMPLES | $\bar{H}$ | S |
|---|---|---|
| A | 4.30" | 1.83" |
| B | 5.90" | 1.80" |
| C | 6.90" | 2.06" |
| D | 6.50" | 1.95" |
| E | 3.90" | 1.42" |

The letters "A", "B", "C", "D" and "E" represent different sets of samples of our rim-fire mix, and the column under "$\bar{H}$" reflects the average height of fire. The column headed by the letter "S" is the statistical standard deviation or, in other words, the degree of randomness. The average height of fire ($\bar{H}$) is the height from which a two-ounce ball must be dropped upon the rim to cause the primer mix within the rim of 50% of the cartridges to fire. Each of the groups "A", "B", "C", "D" and "E" have ten or more samples within the group, and the figure shown as the height of fire is the average height of fire of that group. As indicated hereinabove, we have found that the most desirable height of fire is 4.5"–5.5".

As shown hereinbefore in Table 1, the average height of fire of our various sets of samples of our new lead-free rim-fire primer varies with a range of 3.90"-approximately 7.0". Thus, Sample C required a height of fire of 6.90", whereas Sample E required a height of fire of only 3.90". Sample A, at 4.30", required a height of fire slightly greater than that required by Sample E. A range of 3.90"–5.0" height of fire has provided satisfactory results, as has the range of 3.90"–6.0" height of fire. Our preferred range of averages of height of fire is 4.5"–5.5".

Like most initiating explosives, cupric azide is safe to process, as long as it is kept wet with water. Thus, it is stored in a wet condition and is charged while still wet. It is formed into pellet forms, and the charging is accomplished by placing the pellet within the casing, and thereafter it is spun so as to move outwardly into the rim of the individual casings. The gum tragacanth is mixed dry with the glass and then added to the cupric azide, tetracene and nitrocellulose, to provide a dough-like mixture, so that it can be charged and processed. The priming mix formed in this manner is stored wet and is charged in a wet condition, after which the pellet is placed within the casing and is spun into the rim while still wet. Thereafter, the contents of the casing is dried so as to become sensitive.

We have tested the stability of our primer mix at 150° F. The results of our test are shown immediately hereinbelow:

TABLE 2

| | CONTROL | | NON-TOXIC | |
|---|---|---|---|---|
| | VELOCITY | PRESSURE | VELOCITY | PRESSURE |
| Ambient Temp | 1,237 | 20,700 | 1,276 | 27,400 |
| 1 week at 150° F. | 1,288 | 24,100 | 1,296 | 31,200 |
| 2 weeks at 150° F. | 1,276 | 23,600 | 1,285 | 28,100 |
| 3 weeks at 150° F. | 1,286 | 24,600 | 1,290 | 30,200 |
| 4 weeks at 150° F. | 1,301 | 26,500 | 1,287 | 27,800 |

It will be seen that we tested the velocity and pressure of control samples and of our new lead-free primer mix. Thus, the top row of figures show the velocity and pressure of the control group at ambient temperature, and the figures immediately to the right thereof show the velocity and pressure of samples of our lead-free rim-fire primer mix. The velocity in each case is measured in feet per second, and the pressure is expressed in pounds per square inch (psi).

The figures immediately therebelow show the velocity and pressure of similar samples at one week at 150° F. and at the second week at 150° F. The group of figures immediately therebelow show the velocity and pressure at three weeks at 150°, and the final row of figures at the bottom show the velocity and pressure at the end of four weeks at 150° F.

The control group is the rim-fire primer mix currently in use at our manufacturer, which utilizes lead styphnate as the primary explosive. All of these figures were obtained under the same circumstances. In each case, the lead-free new primer mix exceeded the values for the control mix. It will be noted that the values at the higher temperatures are higher, which is caused by the fact that higher temperatures produce increased chemical reactivity.

It will also be noted that we do not utilize an oxidizer in our lead-free primer mix. Thus, the new mix is considered more desirable from an environmentalist viewpoint.

Although we prefer to utilize nitrocellulose as one of the ingredients, it is believed that a ground smokeless propellant, such as Hercules fines, will also function suitably.

The above mix may incorporate compatible inorganic oxidizers and a fuel such as aluminum, magnesium, titanium, calcium silicide, etc., as is well known in the art. Such components, however, are not believed to be of value to our mix. Oxidizers and fuels are not needed to effectively ignite the propellants of the rim-fire primer mix disclosed and claimed herein.

An example of how the new lead-free primer mix disclosed and claimed herein is formulated may aid in understanding the invention. The cupric azide is typically prepared in nominal molar concentrations of sodium azide and cupric sulfate in a relatively diluted reaction, although the concentration of the reaction mixture from very concentrated to very diluted does not appear to alter the effectiveness of the cupric azide. An example (laboratory quantity) is 40 ml of 0.5M cupric sulfate and 40 ml of 1.0M sodium azide, caused to react in 400 ml of water at room temperature. The precipitate is filtered on a Buchner funnel and washed several times with cold water. The moisture is then removed until there is about 20% by weight cupric azide. This material is checked for moisture content and stored in sealed containers until used.

In using the above material, a dry blend of components for the final mix (which includes glass and gum tragacanth) is premixed and held until used. The wet materials, namely cupric azide, tetracene and nitrocellulose, are then weighed into the mixing bowl on top of the dry blended material, which is comprised of glass and gum tragacanth. The complete mixture is then blended until homogenous. Excess moisture may be removed on a Buchner funnel to leave a paste. This final paste mix is then stored in airtight containers until used.

In conclusion, we have discovered that an excellent lead-free rim-fire primer mix can be prepared by utilizing a chemical component which heretofore has been shunned for this purpose, because of its high sensitivity. We have discovered that, if we utilize limited proportions of the cupric azide and substantially increase the remaining portions, the resulting compound is safe, economical and practical for manufacture of rim-fire primer mixes. Our tests show that the new primer mix functions in an improved manner, as compared to the typical lead styphnate primer mix in that the lead vapors experienced with the use of lead styphnate are completely eliminated.

In considering this invention, it should be remembered that the present disclosure is illustrative only and the scope of the invention should be determined by the appended claims.

We claim:

1. A lead-free rim-fire primer composition for small arms rim-fire cartridges, the active ingredients of which comprise a mixture of:

(a) about 10%–50% by weight of cupric azide;

(b) 0–10% by weight of tetracene;

(c) 10%–45% by weight of nitrocellulose; and (d) 10%–55% by weight of glass.

2. The lead-free rim-fire primer composition defined in claim 1, wherein the percentage by weight of cupric azide is about 18%.

3. The lead-free rim-fire primer composition defined in claim 1, wherein the percentage by weight of tetracene is about 9%.

4. The lead-free rim-fire primer composition defined in claim 1, wherein the percentage by weight of nitrocellulose is about 26%.

5. The lead-free rim-fire primer composition defined in claim 1, wherein the percentage by weight of glass is about 45%.

6. The lead-free rim-fire primer composition defined in claim 1, wherein the range of cupric azide in said composition is about 10%–36% by weight.

7. The lead-free rim-fire primer composition defined in claim 1, wherein the range of tetracene is about 5%–10% by weight.

8. The lead-free rim-fire primer composition defined in claim 1, wherein the range of nitrocellulose in said composition is about 15–30% by weight.

9. The lead-free rim-fire primer composition defined in claim 1, wherein the range of glass in said composition is about 20–50% by weight.

10. The lead-free rim-fire primer composition defined in claim 1, wherein said composition includes a suitable gum, the range of which is 1–2% by weight.

11. The lead-free rim-fire primer composition defined in claim 1, wherein the percentage of glass by weight is about 45% and the majority of the glass particles are of particles of a size within the range of 0.0039"–0.0059".

12. The lead-free rim-fire primer composition defined in claim 1, wherein the majority of the glass particles are of particles having a size within the range of 0.0039"–0.0059".

13. The lead-free rim-fire primer composition defined in claim 1, wherein the glass is comprised mainly of particles having a size such that said particles are capable of passing through a 100 U.S. sieve but are incapable of passing through a 200 U.S. sieve.

14. The lead-free rim-fire primer composition defined in claim 1, wherein the percentage of glass is about 45% and the majority of the glass particles are of a size such that said particles are capable of passing through a 100 U.S. sieve but are incapable of passing through a 200 U.S. sieve.

15. The lead-free rim-fire primer composition defined in claim 1, wherein the percentage of cupric azide is about 18% by weight, of tetracene is about 9% by weight, of nitrocellulose is about 26% by weight, and of glass is about 45% by weight.

16. The lead-free rim-fire primer composition defined in claim 1, wherein the average height of fire of said primer composition is about 3.90"–6.90".

17. The lead-free rim-fire primer composition defined in claim 1, wherein the average height of fire of said composition is as low as 3.90".

18. The lead-free rim-fire primer composition defined in claim 1, wherein the average height of fire of said composition is about 4.3".

19. The lead-free rim-fire primer composition defined in claim 1, wherein the average height of fire of said composition is about 4.5"–5.5".

20. The lead-free rim-fire primer composition defined in claim 1, wherein the average height of fire of said composition is within the range of 3.90"–5.0".

21. The lead-free rim-fire primer composition defined in claim 1, wherein the average height of fire of said composition is at least as great as 3.90" and less than 6.0".

22. The lead-free rim-fire primer composition defined in claim 1, wherein the average height of fire of said composition is at least as great as 3.90" and less than 7.0".

23. The lead-free rim-fire primer composition defined in claim 1, wherein said composition includes 1–4% by weight of tragacanth gum.

24. The lead-free rim-fire primer composition defined in claim 1, wherein said composition includes about 1.8% by weight of tragacanth gum.

25. The lead-free rim-fire primer composition defined in claim 1, wherein said composition includes 1–4% by weight of a suitable gum chosen from the group consisting of gum tragacanth, gum arabic, guar gum and Karaya gum.

26. The lead-free rim-fire primer composition defined in claim 1, wherein said composition includes about 1.8% by weight of a suitable gum chosen from the group consisting of gum tragacanth, gum arabic, guar gum, and Karaya gum.

27. The lead-free rim-fire primer composition defined in claim 1, wherein said composition, upon firing under ambient conditions from a 0.22 caliber cartridge, generates an average pressure of approximately 24,000 psi and develops an average bullet velocity of approximately 1,050–1,300 ft. per second.

28. The lead-free rim-fire primer composition defined in claim 1, wherein said composition, upon firing under ambient conditions from a 0.22 caliber cartridge casing, generates an average pressure of approximately 20,000–28,000 psi and develops an average bullet velocity of at least 1,050–1,300 ft. per second.

29. A lead-free rim-fire primer mix composition in which the primary explosive comprises 10%–50% by weight of cupric azide.

30. A lead-free rim-fire primer mix composition in which the primary explosive comprises about 10–36% by weight of cupric azide.

31. A lead-free rim-fire primer mix composition in which the primary explosive comprises about 18% by weight of cupric azide.

32. A lead-free rim-fire primer mix composition comprising a primary explosive of 10–50% by weight of cupric azide and a secondary explosive of 0–10% by weight of tetracene.

33. A lead-free rim-fire primer mix composition comprising a primary explosive of about 10–36% by weight of cupric azide and a secondary explosive of about 5–10% by weight of tetracene.

34. A lead-free rim-fire primer mix comprising a primary explosive of about 18% by weight of cupric azide and a secondary explosive of about 9% by weight of tetracene.

35. A lead-free rim-fire primer mix composition defined in claim 1, wherein the range of percentages are about 10–36% by weight of cupric azide, 5–10% by weight of tetracene, 15–30% by weight of nitrocellulose, 20–50% by weight of glass, and 1–2% by weight of a suitable gum.

36. A lead-free rim-fire primer mix composition defined in claim 1, wherein the percentages are about 18% by weight of cupric azide, about 9% by weight of tetracene, about 26% by weight of cellulose, about 45% by weight of glass, and about 1.8% by weight of a suitable gum.

37. A lead-free rim-fire primer in which its active ingredients includes cupric azide as a primary explosive, nitrocellulose as a fuel, and glass as a frictionator.

38. The lead-free rim-fire primer defined in claim 37, and a binder selected from the group of gum tragacanth, gum Arabic, guar gum and Karaya gum.

39. A method of igniting a rim-fire cartridge through the use of cupric azide as an active ingredient in the rim-fire primer mix.

40. The method of igniting a rim-fire cartridge as defined in claim 39, wherein cupric azide is used as the primary explosive, nitrocellulose is used as a fuel, and glass is used as a frictionator, in the rim-fire primer mix.

41. In the manufacture of a lead-free rim-fire primer mix, the use of cupric azide as the primary explosive of the mix.

42. In the manufacture of a lead-free rim-fire primer mix, the use of the combination of cupric azide as the primary explosive, of nitrocellulose as a fuel, and of glass as a frictionator.

* * * * *

UNITED STATES PATENT AND TRADEMARK OFFICE
CERTIFICATE OF CORRECTION

PATENT NO. : 5,610,367

DATED : March 11, 1997

INVENTOR(S) : Erickson et al

It is certified that error appears in the above-identified patent and that said Letters Patent is hereby corrected as shown below:

Title Page , under "Attorney, Agent, or Firm," "Shroeder" should read --Schroeder--.

Column 6, line 10, "NON-TOXIC" should read --NON-TOXIC MIX--.

Column 8, Claim 13, line 2, "glass is comprised mainly of particles having" should read --majority of the glass particles are of--.

Signed and Sealed this

Twenty-seventh Day of May, 1997

*Attest:*

Bruce Lehman

BRUCE LEHMAN

*Attesting Officer*

*Commissioner of Patents and Trademarks*